US006516959B1

(12) United States Patent
Gribbins et al.

(10) Patent No.: US 6,516,959 B1
(45) Date of Patent: Feb. 11, 2003

(54) CADDY FOR CLEANING EQUIPMENT

(75) Inventors: Mary Kathleen Gribbins, Lebanon, KY (US); George Trudel Wilson, Lebanon, KY (US)

(73) Assignee: Team BG2S, LLC, Lebanon, KY (US)

( * ) Notice: Subject to any disclaimer, the term of this patent is extended or adjusted under 35 U.S.C. 154(b) by 0 days.

(21) Appl. No.: 10/042,469

(22) Filed: Jan. 10, 2002

(51) Int. Cl.[7] ..... A47F 5/00

(52) U.S. Cl. ..... 211/205; 211/66; 211/70.6; 248/158; 248/311.2

(58) Field of Search ..... 211/66, 205, 107, 211/65, 70.6, 196; 248/158, 311.2, 315

(56) References Cited

U.S. PATENT DOCUMENTS 766,934 A * 8/1904 Danhour
1,259,623 A * 3/1918 Herrick
1,525,701 A * 2/1925 Rose et al.
1,763,748 A * 6/1930 Best
2,447,924 A * 8/1948 Vitale
2,623,642 A * 12/1952 Looney
3,076,557 A * 2/1963 Husted et al.
3,141,557 A * 7/1964 Marschak
4,865,283 A * 9/1989 Parker ..... 211/205 X
5,114,023 A * 5/1992 Lavin ..... 211/107
6,227,510 B1 * 5/2001 McMullen ..... 248/311.2

* cited by examiner

*Primary Examiner*—Robert W. Gibson, Jr.
(74) *Attorney, Agent, or Firm*—Heslin Rothenberg Farley & Mesiti P.C.

(57) ABSTRACT

A caddy assembly for storing cleaning equipment in which a vertical pole member extends upwardly from a flat base with bottle holder cups and hook elements on opposite sides of the pole member and with parallel rack elements projecting to each side of the top of the pole member to receive brooms and mops with their working ends upwardly.

7 Claims, 2 Drawing Sheets

CADDY FOR CLEANING EQUIPMENT

BACKGROUND OF INVENTION

This invention relates to improvements in the design of what is known as a caddy, which in general terms is a device for storing or holding objects when not in use. More particularly, the invention concerns a caddy assembly for storing cleaning equipment in an industrial or factory workplace. The principal object of the invention is to provide a movable caddy stand which can hold brooms and mops in a rack with their handles downwardly so that their working ends are clearly visible for inspection, and also for holding bottles of cleaning materials and the like and related objects used in maintenance work such as clipboards.

Various tool holders and organizers are known such as those described in U.S. Pat. Nos. 5,772,047, 5,810,177, 5,842,566 and 5,881,891 and also U.S. Design Patent No. 429,071. Perhaps the most relevant prior disclosure is in U.S. Pat. No. 3,780,874 which describes a unit for holding cleaning implements. Its design is less than satisfactory, however, because it can hold only four brooms or mops with handles downwardly and then only with the remote handle end portions received in relatively shallow sockets which may or may not fit the handle diameters to hold them vertically upright. Also the apparatus of this reference supports two other broomlike tools with their handles upwardly and it includes various hook elements all on a plurality of upwardly converging legs.

SUMMARY OF THE INVENTION

In accordance with the invention a caddy assembly is provided for storing cleaning equipment and it includes a substantially flat base with a vertical multi-sided pole member extending upwardly from a central portion of the base to a height of approximately four to six feet. A plurality of upwardly open bottle holder cups are mounted respectively on a first pair of opposite sides of the pole member above the midpoint thereof. A plurality of upwardly directed hook elements are mounted on a second pair of opposite sides of the pole member above the mid-point thereof. A pair of horizontal closely spaced extended parallel rack elements are secured to and project outwardly to each side of a to portion of the pole member with opposite ends of the pair of rack elements spaced apart to receive a plurality of broomlike articles, which is to say brooms or mops or the like with their working ends upwardly and handle ends downwardly.

In a preferred form of the caddy assembly the flat base is circular and the pole member is four sided. Two of the cups may be mounted respectively on two opposite sides of the pole member and two of the hook elements made by mounting the other two opposite sides of the pole member above the cups. The rack elements may include upwardly turned stop portions at their opposite ends to prevent unintentional displacement of the broomlike articles from between the rack elements. In a preferred form the pair of horizontal rack elements are secured substantially at their midpoint at the top of the pole member.

Description of Preferred Embodiment

Figure 1:
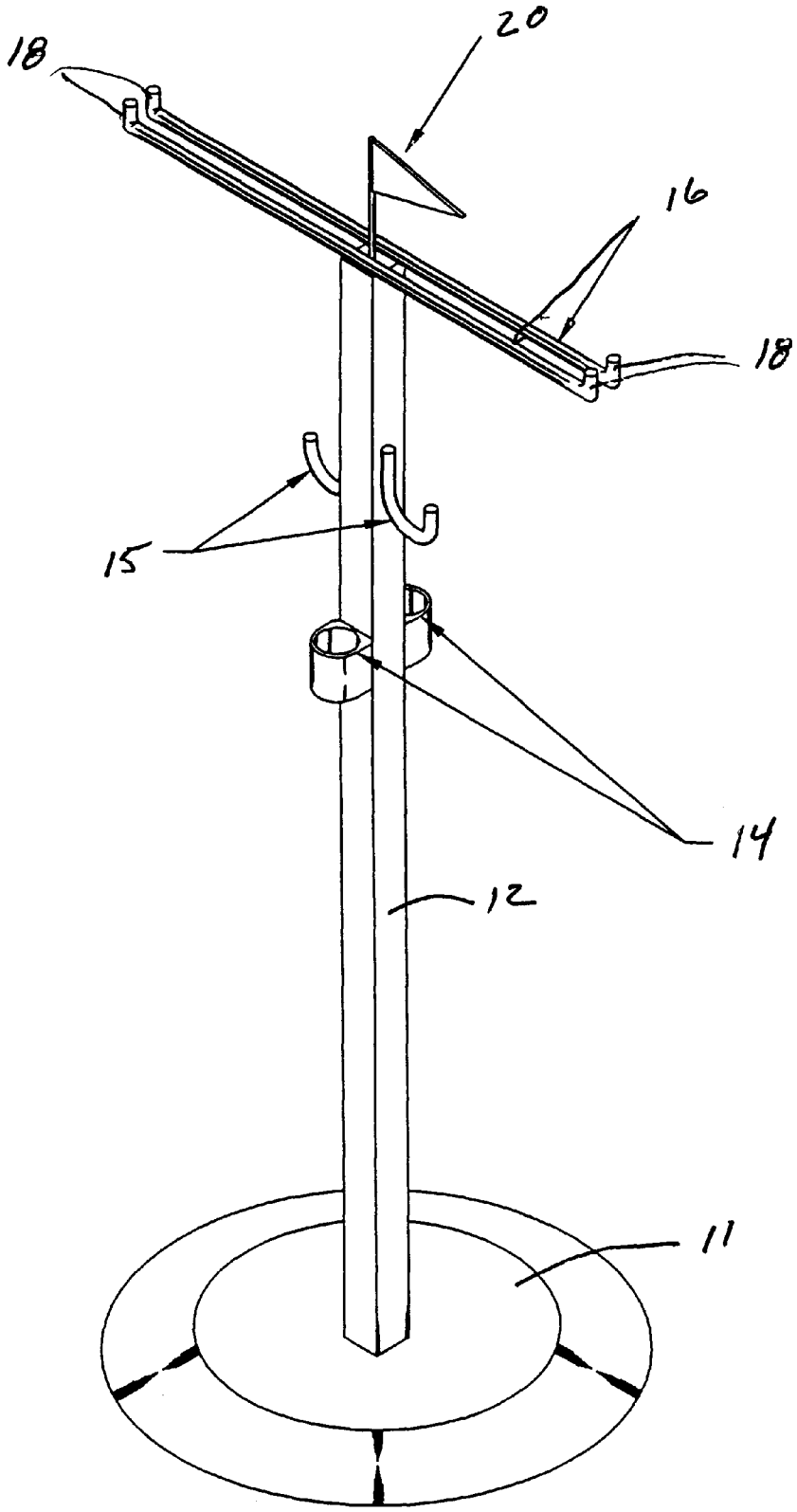
FIG. 1 is a perspective view of a preferred form of the cleaning equipment caddy of the invention.
Figure 2:
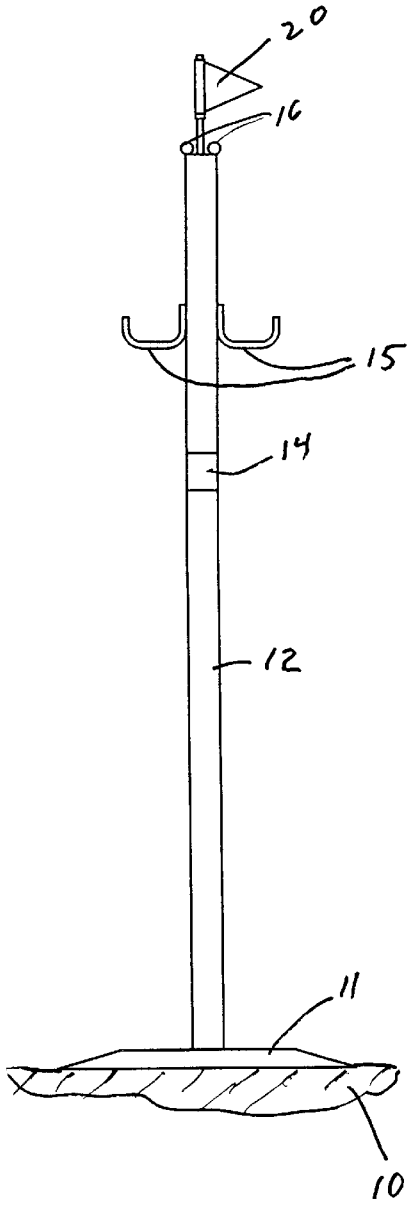
FIG. 2 is a side elevation of the caddy assembly of FIG. 1.
Figure 3:
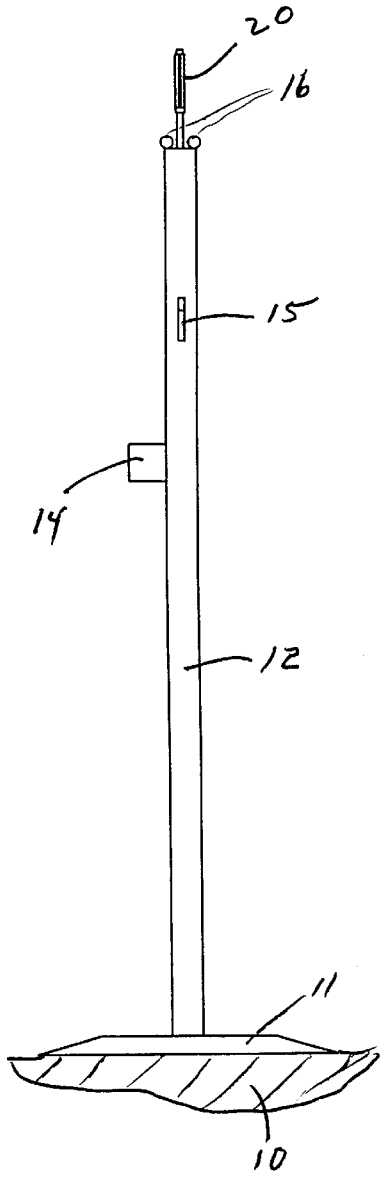
FIG. 3 is a side elevation of the caddy assembly of FIG. 1 ninety degrees around from the side shorn in FIG. 2.

Referring to each of FIGS. 1 to 3, the caddy assembly of the invention is mounted on the floor 10 of a shop or factory at a work station chosen for ready access by janitorial team members. The assembly includes a circular substantially flat base 11 approximately three feet in diameter preferably of elastic so as to be resistant to corrosive material which may be on the floor 10. A single pole member 12 extends upwardly from the center of the base 11 to a height of about four to six feet and it too may be of plastic. The pole member 10 is affixed at the base 11 by any appropriate means so as to be either detachable or permanently secured. In the preferred form the pole member 12 is four-sided and (of square lateral cross section throughout its length. Above the vertical midpoint of the pole member 12 are secured two upwardly open bottle holder cups 14 mounted respectively on two opposite sides of the pole member 12. Each of the cups 14 has a closed bottom and an open top to receive bottles of fluids such as cleaners, detergents and rinses.

On the other two opposite sides of the four-sided pole member 12 are mounted respectively two upwardly directed hook elements 15. They are above the cups 14 closer to eye level for good visibility. Dust pans or the like may be suspended from the hook elements 15 or they may be utilized to hold clipboards bearing scheduling or instructional material.

At the very top of the pole member 12 in a pair of horizontal closely spaced extended rigid rack elements 16. They are secured at the top of the pole member 12 at their midpoint and therefore project outwardly an equal distance to each side. Opposite ends of the rack elements 16 are spaced apart to receive brooms and mops with their working ends upwardly and their handle ends downwardly. At opposite ends of the rack elements 16 are upwardly turned stop elements 18 which prevent unintentional displacement of the broomlike articles from between the rack elements 16. Several brooms and mops, perhaps half a dozen in number, may be caused to slide between the rack elements 16 to each side of the pole member 12.

Extending upwardly from the top of the pole member 12 is a flag 20 which allows the caddy assembly to be easily seen from both inside and outside the work center where the caddy assembly is located.

The scope of the invention is to be determined by the following claims rather than from the foregoing description of a preferred embodiment.

What is claimed is:

1. A caddy assembly for storing cleaning equipment comprising a) a substantially flat base, b) a vertical multi-sided pole member extending upwardly from a central portion of the base to a height of approximately four to six feet, c) a plurality of upwardly open bottle holder cups mounted respectively on a first pair of opposite sides of the pole member above the midpoint thereof, d) a plurality of upwardly directed hook elements mounted on a second pair of opposite sides of the pole member above the midpoint thereof, and e) a pair of horizontal closely spaced extended parallel rack elements secured to and projecting outwardly to each side of a top portion of the pole member with opposite ends of the pair of rack elements spaced apart to receive a plurality of broomlike articles with their working ends upwardly and handle ends downwardly.

2. A caddy assembly according to claim 1 wherein the flat base is circular.

3. A caddy assembly according to claim 1 wherein the pole member is four-sided.

4. A caddy assembly according to claim 3 wherein two of said cups are mounted respectively on two opposite sides of the pole member and two of said hook elements are mounted on the other two opposite sides of the pole member above the cups.

5. A caddy assembly according to claim 1 wherein the rack elements include upwardly turned stop portions at their opposite ends to prevent unintentional displacement of said broomlike articles from between the rack elements.

6. A caddy assembly according to claim 1 wherein the pair of horizontal rack elements are secured substantially at their midpoint to the top of the pole member.

7. A caddy assembly for storing cleaning equipment comprising a) a flat circular base, b) a vertical four-sided pole member extending upwardly from the center of the base to a height of four to six feet, c) two upwardly open bottle holder cups mounted respectively on two opposite sides of the pole member above its midpoint, d) two upwardly directed hook elements are mounted respectively on the other two opposite sides of the pole member above the cups, e) a pair of horizontal closely spaced extended race elements secured substantially at their midpoint to and projecting outwardly to each side of the top of the pole member with opposite ends of the pair of rack elements spaced apart to receive a plurality of broomlike articles with their working ends upwardly and handle ends downwardly, and f) upwardly turned stop portions at opposite ends of the rack elements to prevent unintentional displacement of the broomlike articles from between the rack elements.

* * * * *

UNITED STATES PATENT AND TRADEMARK OFFICE

CERTIFICATE OF CORRECTION

PATENT NO. : 6,516,959 B1 
DATED : February 11, 2003
INVENTOR(S) : Gribbins et al.

It is certified that error appears in the above-identified patent and that said Letters Patent is hereby corrected as shown below:

Column 4,
Line 9, delete the word "race" and insert -- rack --

Signed and Sealed this

Twenty-fourth Day of June, 2003

JAMES E. ROGAN
*Director of the United States Patent and Trademark Office*